US005375682A

United States Patent [19]

Göpner

[11] Patent Number: 5,375,682

[45] Date of Patent: Dec. 27, 1994

[54] ELEVATOR SYSTEM

[76] Inventor: Michael Göpner, Nietlehener Str. 1, Halle/S. 06126, Germany

[21] Appl. No.: 108,334

[22] Filed: Aug. 18, 1993

[30] Foreign Application Priority Data

Aug. 19, 1992 [DE] Germany ..... 9211091

[51] Int. Cl.[5] ..... B66B 17/12

[52] U.S. Cl. ..... 187/411; 187/1 R; 187/414

[58] Field of Search ..... 187/94, 1 R

[56] References Cited

U.S. PATENT DOCUMENTS 12,640 4/1855 Murtaugh ..... 187/94 X
548,978 10/1895 Foster ..... 187/1 R

FOREIGN PATENT DOCUMENTS 1439145 4/1965 France .
1547817 11/1967 France .
1198972 8/1965 Germany ..... 187/1 R X
1321279 12/1989 Japan ..... 187/1 R X
289789 3/1990 Japan ..... 187/1 R X
2282177 11/1990 Japan ..... 187/1 R X
2295876 12/1990 Japan ..... 187/1 R X
966783 8/1964 United Kingdom ..... 187/94 X
2223471 4/1990 United Kingdom .

*Primary Examiner*—Robert P. Olszewski
*Assistant Examiner*—Dean A. Reichard
*Attorney, Agent, or Firm*—Friedrich Kueffner

[57] ABSTRACT

An elevator system for conveying persons and/or loads has at least two elevators arranged in separate elevator shafts immediately next to each other. The counterweights of at least two elevators are arranged in one elevator shaft and the elevator in the other elevator shaft has a size which is adapted to the cross-sectional area of the elevator shaft.

8 Claims, 3 Drawing Sheets

ELEVATOR SYSTEM

BACKGROUND OF INVENTION

1. Field of the Invention

The present invention relates to an elevator system including a plurality of elevators arranged immediately next to each other in separate shafts for conveying persons and/or loads.

2. Description of the Related Art

During the renovation of old buildings, such as, apartment buildings, retirement homes, nursery homes and hospitals, it is necessary to convert already existing elevator systems and to adapt them to the required standards. It is generally known that elevator systems for conveying persons or loads are arranged in elevator shafts, wherein each elevator car is moved vertically in guide tracks. The drive unit with the controls is usually arranged above the elevator shaft. The horizontal cross-sectional area of the elevator shaft is dimensioned in such a way that, in addition to space for the elevator car, there is sufficient space for guiding the counterweight.

When existing elevator systems are to be renovated, there may be significant problems if an elevator car is to be used which has a larger transverse cross-sectional area. For example, in older retirement homes, frequently two elevators are arranged separate shafts next to each other which each serves to convey a small number of persons. Because of changes in the configuration of retirement homes, it has become necessary in the meantime to equip these homes with an elevator system in which at least one hospital bed and one or two care persons can be conveyed. In order to be able to meet these requirements, substantial reconstruction work is necessary because a larger elevator car can only be installed if a completely new shaft having a larger transverse cross-sectional area is constructed. If two or more elevators are already present next to each other, the reconstruction work still is very expensive, particularly with respect to the reconstruction of the elevator shafts.

SUMMARY OF THE INVENTION

Therefore, it is the primary object of the present invention to provide an elevator system fox elevators arranged in separate shafts immediately next to each other which makes it possible to equip at least one of the already existing elevators with an elevator car which has a substantially greater cross-sectional area, without changing the cross-sectional area of the already existing elevator shafts.

In accordance with the present invention, the counterweights of at least two elevators are guided in one elevator shaft, wherein an elevator is arranged in this shaft in addition to the counterweights. Thus, in this elevator shaft, the elevator car and its counterweight are arranged as well as at least one additional counterweight which is connected through a cable to the elevator car of an elevator operated in the adjacent elevator shaft. In addition, it is possible, for example, to guide two counterweights of adjacent elevators in the elevator shaft with the elevator car and the counterweight. Accordingly, since at east one of the elevator shafts no longer has a counterweight, it is possible to install in this elevator shaft an elevator car which can be adjusted to the size of the cross-sectional area of the elevator shaft. In other words, in accordance with the requirements, the elevator car can have a transverse cross-sectional area which is almost the size of the cross-sectional area of the elevator shaft, or the elevator car may be made smaller. However, in most cases, the elevator car in the elevator shaft without counterweight will have a greater useful area than the elevator car arranged in the adjacent elevator shaft which contains the counterweight. For safety reasons, it is useful to separate the part of the elevator shaft in which one or more counterweights of adjacent elevators are guided by means of a separating wall, preferably a grate.

The elevator with the elevator car having the larger cross-sectional area may be constructed as a hospital bed elevator and the elevator with the elevator car having the smaller cross-sectional area may be an elevator for the handicapped. The elevator for the handicapped may have a higher transportation capacity than the hospital bed elevator.

The counterweights may be either arranged at a sidewall or on opposite sidewalls of the elevator shaft.

The elevator system according to the present invention provides the primary advantage that it is not necessary to build new elevator shafts and, thus, the reconstruction costs can be substantially lowered.

The various features of novelty which characterize the invention are pointed out with particularity in the claims annexed to and forming a part of the disclosure. For a better understanding of the invention, its operating advantages, specific objects attained by its use, reference should be had to the drawing and descriptive manner in which there are illustrated and described preferred embodiments of the invention.

DESCRIPTION OF THE PREFERRED EMBODIMENTS

Figure 1:
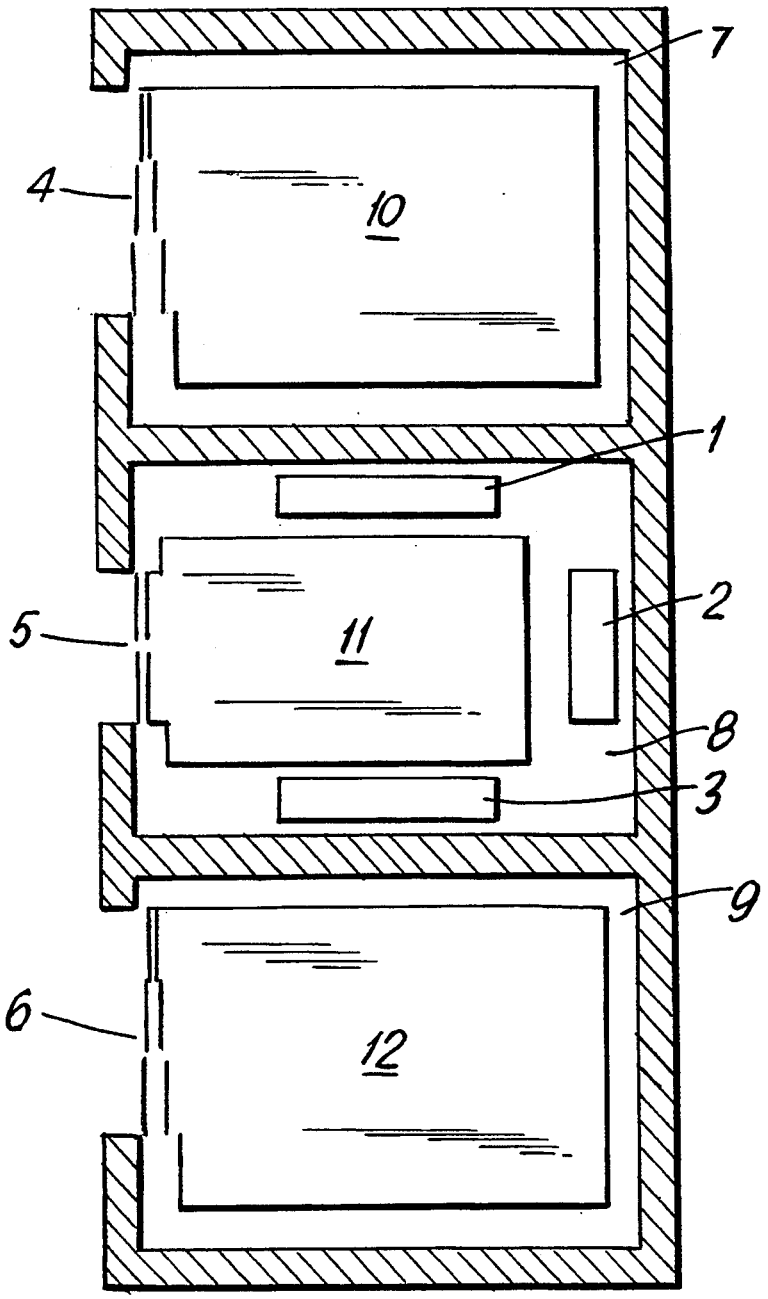
FIG. 1 is a schematic sectional view of an elevator system having three elevator shafts arranged immediately next to each other.

As illustrated ill FIG. 1 of the drawing, the elevator system has three elevator shafts 7, 8, 9 with three elevators 4, 5, 6. The elevators are completely equipped, wherein the drive units with controls are arranged above the respective elevator shaft. It is also possible to operate the three elevators by means of a common control unit.

The counterweights 1, 2, 3 of the elevator cars 10, 11, 12 are guided in a common elevator shaft 8. Additional guide rollers, not shown in the drawing, are used for guiding the cables of the respective counterweights of the adjacent elevator cars 10, 11 and 12. For safety reasons, grates are used for dividing off those portions of the elevator shaft in which the counterweights 1 and 3 are guided. As a result, it is now possible to utilize the entire existing cross-sectional area of the elevator shafts 7 and 9 for arranging larger elevator cars. Since the counterweights 1, 2, 3 are arranged in the elevator shaft 8, the elevator car 11 in this shaft 8 has a correspondingly smaller cross-sectional area.

Figure 2:
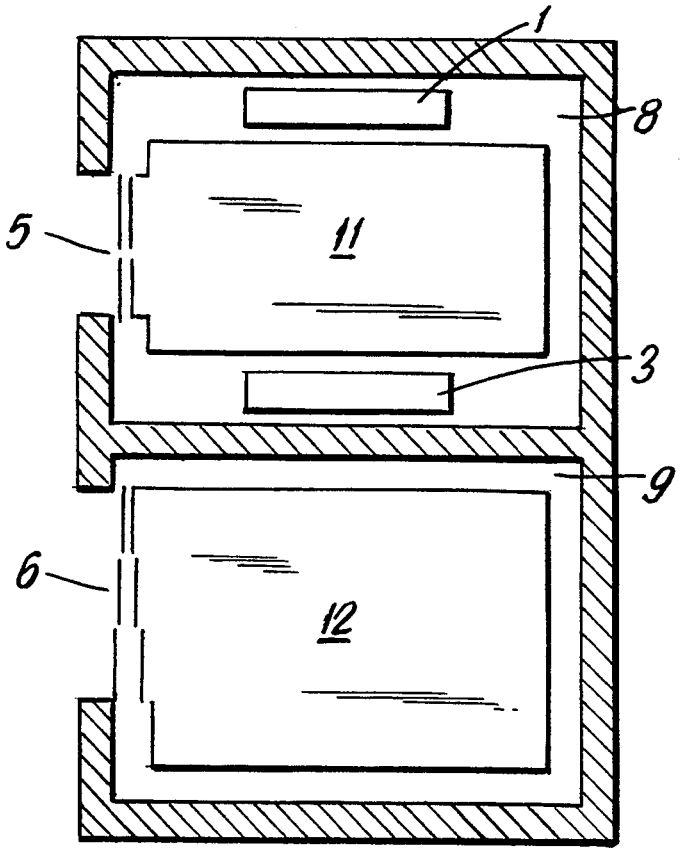
FIG. 2 is a schematic sectional view of an elevator system having two elevator shafts arranged immediately next to each other.

FIG. 2 of the drawing shows another elevator system with two elevators arranged in elevator shafts arranged immediately next to each other. When the arrangement is carried out in accordance with the present invention, the elevator car 12 may be adjusted in its cross-sectional area to the available cross-sectional area of the elevator shaft 9. Because of the guidance of the counterweights 1, 3 at the sidewalls of the elevator shaft 8, it is only necessary to reduce the width of the elevator car 11.

It has been found in practice that the elevator system according to the present invention is particularly suitable for reconstructing typical elevator systems of retirement homes. The dimensions of the elevator shaft for these elevators are 2.15 m×2.60 m. The elevator cars used in the past for these elevator shafts have a cross-sectional area of 1.11 m×2.21 m. In these elevator cars, it was not possible to transport a patient in a hospital bed and one or two of the necessary care persons. Without changing the cross-sectional area of the elevator shafts, the present invention makes it possible to install in the elevator shaft 9 an elevator car having a cross-sectional area of 1.80 m×2.20 m. This means that sufficient space is available in this elevator car for a hospital bed and accompanying personnel. In spite of the presence of the two counterweights 1, 3, it is possible to arrange in the other elevator shaft 8 an elevator car having a cross-sectional area of 1.10 m×2.10 m. This elevator may be equipped as all elevator for the handicapped, in which it is even possible to transport one or two persons in addition to a patient on a stretcher. This elevator may also have a higher travel speed, a faster door closing time and, thus, a higher transportation capacity than the hospital bed elevator in elevator shaft 9.

Figure 3:
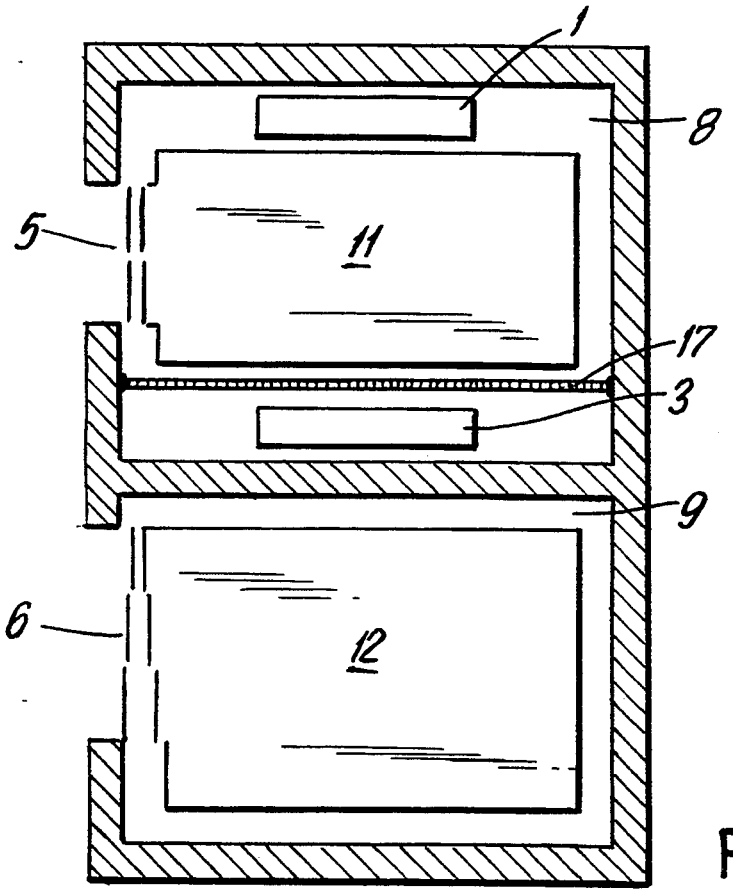
FIG. 3 is a schematic sectional view similar to FIG. 2, showing a grate between an elevator and a counterweight in one of the elevator shafts.
Figure 4:
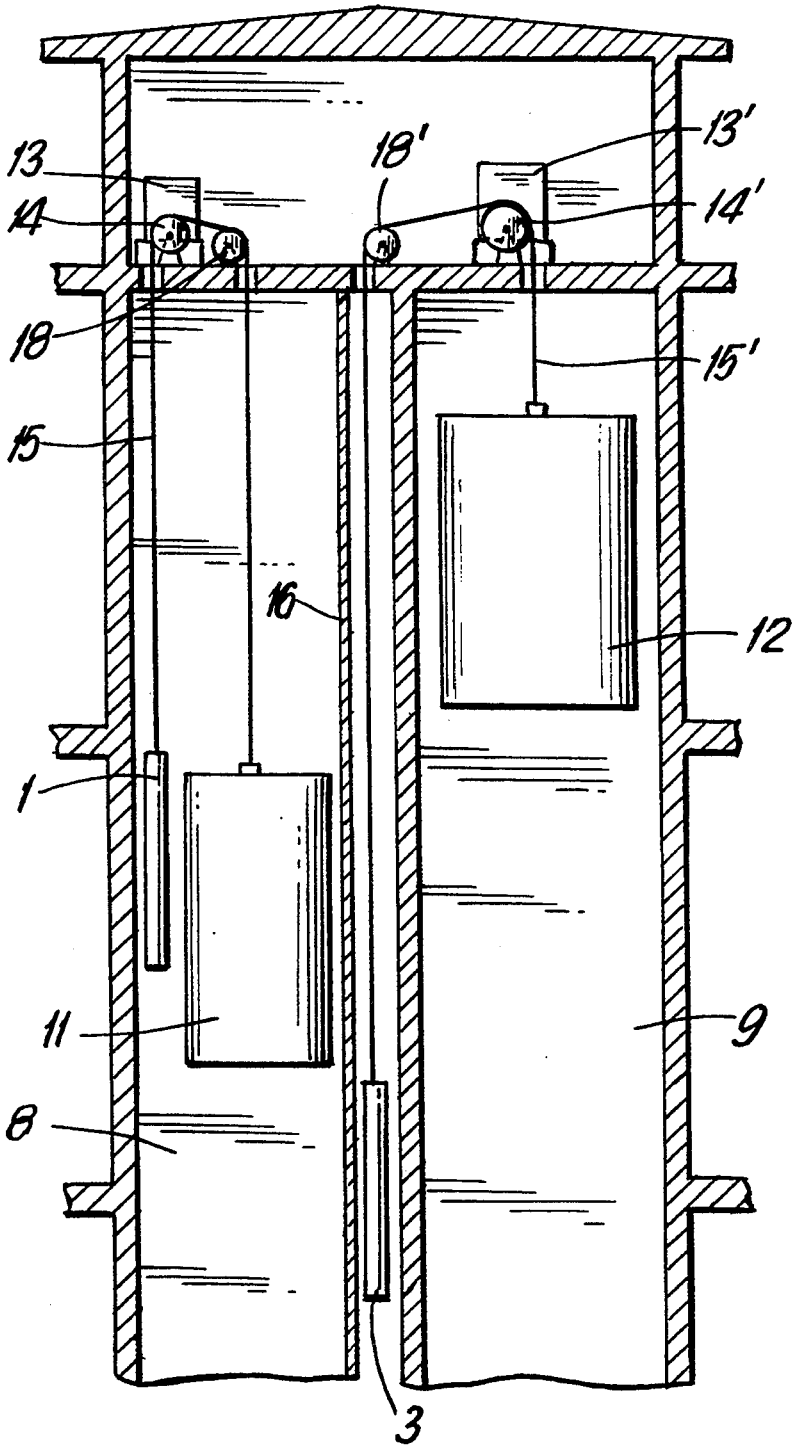
FIG. 4 is a schematic sectional side view of an elevator system having two elevator shafts arranged immediately next to each other.

FIG. 4 of the drawing shows in a schematic side view the elevator system according to the present invention with two elevator shafts 8 and 9 arranged immediately next to each other. Drive and control units 13, 13' are arranged above the elevator shafts. A cable 15 extends between the counterweight 1 and the elevator car 11 and a cable 15' extends between the counterweight 3 and the elevator car 12. The cables 15, 15' extend over drive disks 15, 15' and guide rollers 18, 18', respectively. A separating wall 16 separates the elevator car 11 from the counterweight 3. As illustrated in FIG. 3, the separating wall may also be a grate 17.

Of course, the elevator cars can also be configured differently depending on the type and the requirements of the transportation capacities, for example, as elevators for persons or as combination elevators for the transportation of loads and persons.

The invention is not limited by the embodiments described above which are presented as examples only but can be modified in various ways within the scope of protection defined by the appended patent claims.

I claim:

1. An elevator system comprising at least two elevators arranged in separate elevator shafts arranged immediately next to each other, each elevator including an elevator car, a drive and control unit mounted above each elevator shaft, and a counterweight each connected to one of the elevator cars by means of a cable extending over a drive disk, wherein the counterweights of at least two elevators are arranged in a first of the elevator shafts, and wherein the elevator arranged in a second of the elevator shafts has a cross-sectional size adapted to the cross-sectional size of the second elevator shaft.

2. The elevator system according to claim 1, wherein the elevator car in the second elevator shaft has a larger useful area than the elevator car in the first elevator shaft.

3. The elevator system according to claim 1, comprising a separating wall for dividing off a portion of the first elevator shaft containing the counterweights.

4. The elevator system according to claim 3, wherein the separating wall is a grate.

5. The elevator system according to claim 1, wherein the elevator in the second elevator shaft is a hospital bed elevator and the elevator in the first elevator shaft is an elevator for the handicapped.

6. The elevator system according to claim 5, wherein the elevator for the handicapped has a higher transportation capacity than the hospital bed elevator.

7. The elevator system according to claim 1, wherein the counterweights are arranged immediately adjacent a sidewall of the first elevator shaft.

8. The elevator system according to claim 1, wherein the counterweights are arranged at opposite side walls of the first elevator shaft.

* * * * *